United States Patent [19]

Sauber

[11] Patent Number: 4,657,202

[45] Date of Patent: Apr. 14, 1987

[54] TENSION TAKE-UP SYSTEM FOR DRUMS AND THE LIKE

[76] Inventor: Charles J. Sauber, 10 N. Sauber Rd., Virgil, Ill. 60182

[21] Appl. No.: 843,301

[22] Filed: Mar. 24, 1986

[51] Int. Cl.[4] ..... B65H 75/18

[52] U.S. Cl. ..... 242/117; 254/374

[58] Field of Search ..... 242/117, 118.7, 118.8, 242/118.4, 118.2, 118, 77, 77.3, 54 R, 155 BW, 68, 68.5, 155 R; 254/134.3 R, 134.3 PA, 134.3 FT, 134.5, 371, 374, 902

[56] References Cited

U.S. PATENT DOCUMENTS

| | | | |
|---|---|---|---|
| 2,954,702 | 10/1960 | Petersen | 242/117 X |
| 3,317,149 | 5/1967 | Gooch | 242/155 R X |
| 3,934,482 | 1/1976 | Byers | 254/371 X |
| 4,030,569 | 6/1977 | Berkovitz | 242/155 BW X |

FOREIGN PATENT DOCUMENTS

| | | | |
|---|---|---|---|
| 873189 | 6/1971 | Canada | 242/68.5 |
| 750874 | 6/1956 | United Kingdom | 242/117 |

*Primary Examiner*—Stanley N. Gilreath

*Attorney, Agent, or Firm*—Leydig, Voit & Mayer

[57] ABSTRACT

A tension take-up system for cable support drums and the like features resilient tension absorbing rollers disposed laterally across the winding surface of the drum. The rollers are partially seated into recessed areas defined longitudinally across the winding surface of the drum and progressively dissipate the tensioning forces generated when high tension cable is pulled into position by using pulling line being wound on the support drum. The recessed areas are capable of accommodating expansion of the rollers when they are depressed as the tensioned pulling line is wound over them. The tension absorbing rollers are made of a highly shock absorbent rubbery material so that, as winding progresses, the resulting compressive forces are dissipated by the progressive deformation of the rollers which causes them to expand within the corresponding recesses on the winding surface of the drum. The system is simple and economical to manufacture, requires little maintenance, has prolonged life and can be adapted for use in a variety of cable laying or winding applications.

6 Claims, 6 Drawing Figures

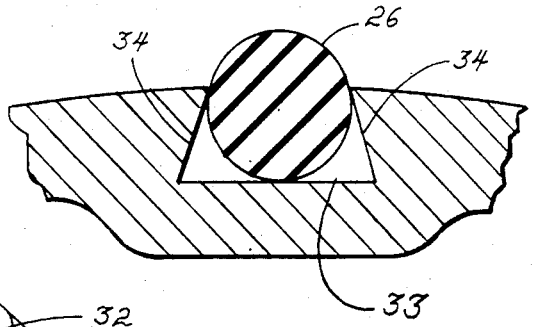
FIG. 2A
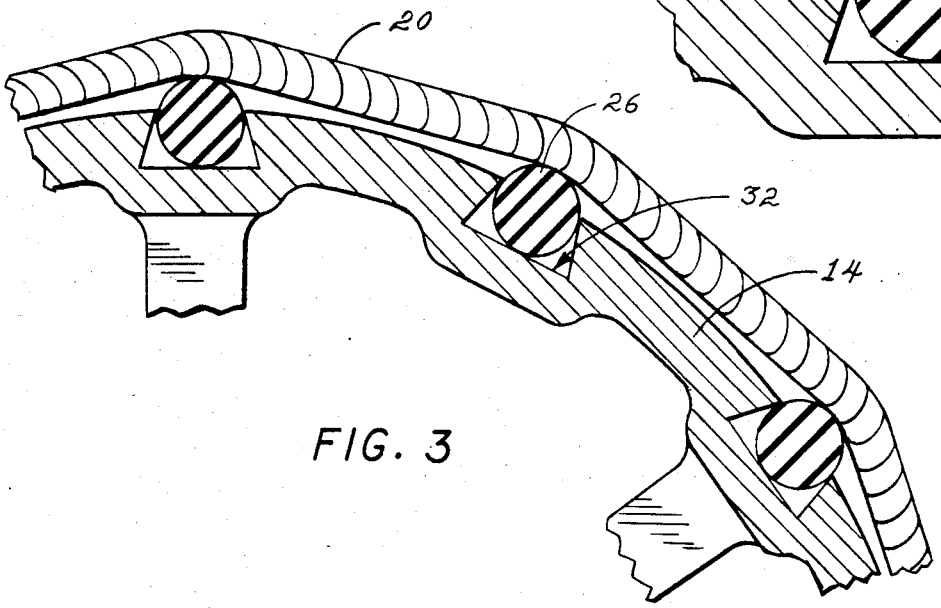
FIG. 3
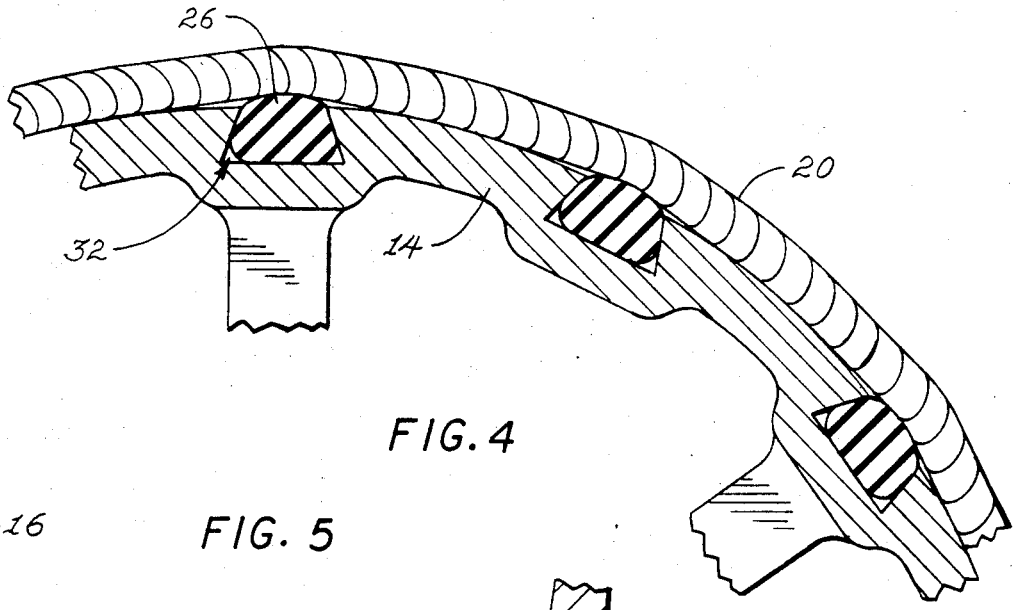
FIG. 4
FIG. 5
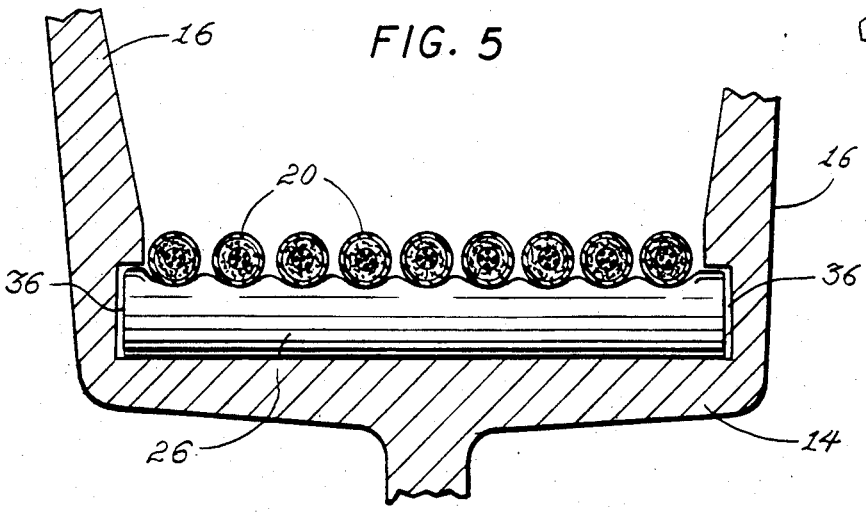

TENSION TAKE-UP SYSTEM FOR DRUMS AND THE LIKE

FIELD OF THE INVENTION

This invention generally relates to cable support devices onto which pulling line used for positioning electrical or like cable may be wound. More particularly, the present invention relates to an improved cable support system which permits the winding of tensioned pulling line without collapsing the support device and is relatively low cost, convenient and simple to manufacture.

BACKGROUND OF THE INVENTION

In electrical wire or cable stringing applications, such as situations where wire is pulled through conduit by a cable or line at a desired and controlled rate, there is a need for the pulling cable or line to be supported under tension by use of some form of a cable support device such as a drum or spool. In cable laying operations the heavy electrical or mechanical cable to be pulled under tension through support conduits, is in conventional practice hooked up to some kind of 'fish wire' or 'pulling line' attached to the leading end of the cable and then the pulling line pulls the heavy cable through the conduit until it is in the desired position. The pulling action is generally accomplished through a cable support drum or spool which is capable of being rotated. The drum provides an anchoring surface on which the pulling line may be wound so as to utilize the rotational motion of the drum toward imparting pulling action on the cable. Under such conditions, forces are generated which accumulate and tend to collapse the drum or spool onto which the pulling line is being wound. Such collapsing generally occurs as a result of the cumulative effects of tension generated during the pulling action. One such effect is the direct result of the cable being under tension while it is actually being pulled by the pulling line. Another affecting factor is the force existing due to the weight of the cable itself, which can amount to a significant value depending upon the particular cable winding application. The weight of the cable adds considerably to the operating tension particularly when the pulling line is working at lifting heavy cable through large distances in vertical conduits, against gravitational forces. Since the surface of the drum onto which the pulling line is wound is the effective fulcrum of support, it is subjected to all the accumulated forces resulting from the tension generated as the pulling line is progressively wound or unwound around the support drum. Such accumulated forces of tension tend to collapse the drum or spool during the cable pulling operation. This collapsing effect of the tensioning forces is compounded when the cable pulling operation requires intermittent 'pulling' and 'braking' actions of the pulling line, which frequently is the case. In the past, this problem has been solved, among other ways, by the use of winding drums or spools made of heavy duty material capable of withstanding the compressive forces generated during high tension winding. Such solutions entail increased cost for the stronger drum materials as well as related cost and inconvenience in handling the significantly increased weight of the stronger drums.

SUMMARY AND OBJECTS OF THE INVENTION

Accordingly, it is a primary object of the present invention to provide an improved tension take-up system which enables heavy electrical cable or the like to be positioned by using pulling line wound under tension onto the cable support or winding drums with significantly reduced likelihood of the accumulated tension collapsing the drum.

It is a related object to provide such an improved tension take-up system which is relatively light in weight, and convenient and reliable to use.

Another object of this invention is to provide a system of the above kind in a form which is economical to manufacture and use.

The above objects are realized, according to this invention, by providing an improved cable winding drum that has tension absorbent rollers placed laterally across the winding surface of the drum. The tension absorbent rollers are partially seated into recesses defined on the winding surface of the drum and the recesses are so shaped that they are capable of accommodating expansion of the tension absorbent rollers when they are depressed as a result of tension generated during the winding operation. The rollers are made of a highly shock absorbent rubbery material so that as the winding operation progresses, the compressive forces generated due to the tensioned winding of the pulling line which supports the cable progressively depress the absorbent rollers causing them to expand within the corresponding recesses on the drum winding surface, thereby absorbing and dissipating the built up forces and reducing the likelihood of the winding drum collapsing under the cumulative effects of the tension as the line is being wound. The tension absorbent rollers and matching recesses are designed to tightly mate with each other and retaining notches are provided around the drum so that the system requires no external means of restraint in order to position the rollers within the recesses. This permits easy and convenient replacement of the absorbent rollers in the event of their wearing out over prolonged use. This system provides an easy means for increasing the stability of winding drums under high tension winding applications and for any given material of the drum provides significantly improved resistance to the collapsing of the winding drum in such applications.

Other objects and advantages of the invention will become apparent as the following description proceeds and when taken in conjunction with the accompanying drawings.

BRIEF DESCRIPTION OF THE DRAWINGS

FIG. 2*a* is a fragmentary cross-sectional side view of the improved cable winding drum illustrating the mating relationship of the tension absorbing rollers and the surrounding recess;

FIG. 3 is a fragmentary sectional side view of the improved cable winding drum illustrating the relative positioning of the tension absorbing cylinders and the pulling line at the start of the winding operation;

FIG. 4 is a fragmental sectional view illustrating the relative positioning of the tension absorbing rollers and the pulling line as the winding of the tensioned line proceeds; and FIG. 5 is a sectional end view illustrating the relative positioning of a plurality of coils of the tensioned pulling line as it is wound around the tension absorbing cylinders and the resulting deformation of the cylinders.

DETAILED DESCRIPTION OF THE PREFERRED EMBODIMENT

While the invention will be described in connection with a particular preferred embodiment, it will be understood that it is not intended to limit the invention to that particular embodiment. On the contrary, it is intended to cover all alternatives, modifications and equivalents as will be included within the spirit and scope of the invention as defined by the appended claims.

Figure 1:
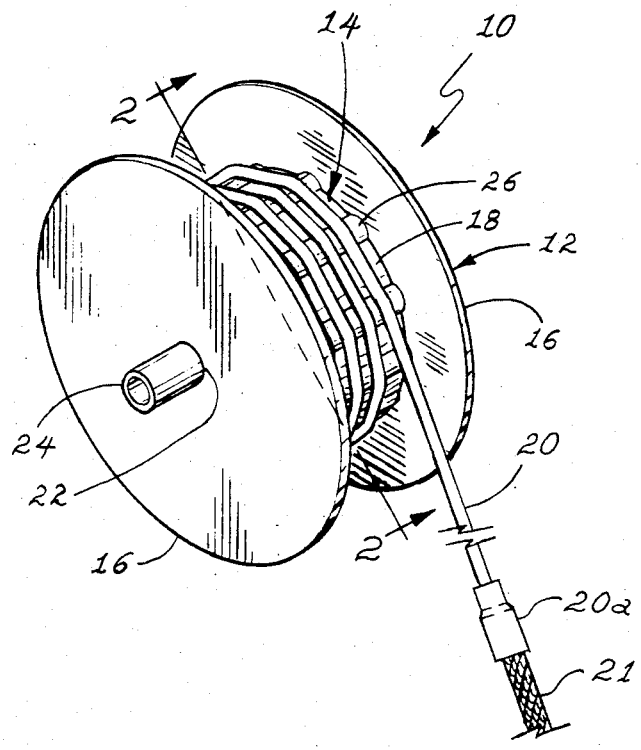
FIG. 1 is a side perspective view of an improved cable winding drum according to the system of this invention.

Referring now to FIG. 1, there is shown a sectional end view of an improved cable winding drum according to the system of this invention. The cable winding drum 10 is basically in the form of a conventional spool 12 which comprises a central drum 14 of substantially cylindrical shape and having enlarged disc-like ends 16. The central drum 14 defines a winding surface 18 onto which the 'fish wire' or pulling line cable 20 is wound. The pulling line 20 is attached through suitable coupling means 20A to the leading end of the cable 21 which is to be pulled into position through a support conduit or similar structure (not shown) by using the pulling line 20. The spool 12 has a central opening 22 through which a support shaft 24 is placed and functions as the axis of rotation for the revolving motion of the spool. The actual structural arrangement for supporting the overall cable winding system is not shown as it is fairly conventional and may include a truck bed along with spaced upright columns and angle braces for supporting the system, means for mounting the spool 12 on the support shaft 24 to effect rotation as a unit and restrain the spool against axial movement, and separate means for retaining the support shaft 24 itself against axial movement. Such an arrangement is disclosed in U.S. Pat. No. 4,325,522 issued to Charles Sauber.

Regardless of the type of arrangement for effecting the rotational motion of the spool in order to produce the winding action of the pulling line, conventional winding systems have been susceptible to the collapsing of the central drum because of the accumulation of forces due to the tensioning of the pulling line, as the high tension winding operations progressed.

According to this invention, the accumulation of such forces is prevented by progressively dissipating them through tension absorbent means disposed on the winding surface of the central drum. More specifically, as shown in FIG. 1, the central drum 14 is provided with a plurality of tension absorbing rollers 26 disposed on the central drum 14 laterally across its winding surface 18 and in between the enlarged disc-like ends 16 of the spool 12. The pulling line 20 is thus wound not directly on the central drum 14, but over the tension absorbent rollers disposed around the winding surface 18 of the central drum. As the cable pulling and the line winding operation proceeds, the forces tending to collapse the central drum are progressively dissipated by the tension absorbing rollers as will be described below.

Figure 2:
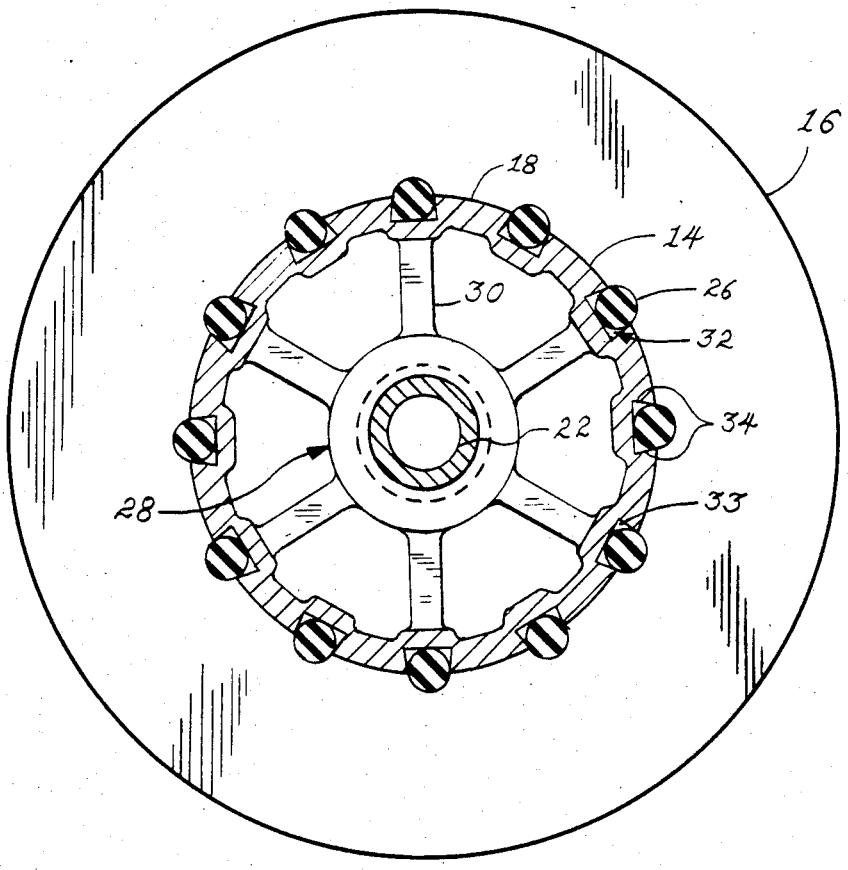
FIG. 2 is a cross sectional view of the cable winding drum according to this invention, taken substantially along the line 2—2 in FIG. 1.

Referring now to FIG. 2, there is shown a sectional side view of the improved cable winding drum according to an illustrative embodiment. As shown, the central drum 14 as well as the disc-like ends 16 are supported by a nuclear structure 28 through radially projecting rigid spoke members 30. The design of such a supporting infrastructure is common and well known in the art and is hence not discussed herein.

In order to accommodate the tension absorbent rollers upon the winding surface of the illustrative winding drum, a plurality of matching recesses are provided on the winding drum. More specifically, the central drum 14 is provided with a plurality of recesses 32 defined laterally across its winding surface 18 and spread out at roughly equidistant points around the periphery of the central drum. The recesses 32 are roughly rectangular in shape but have a broad base 33 with the side walls 34 angling inwards so as to define a relatively narrower opening. The recesses are so designed that the narrow opening is just large enough to fit around the diameter of the tension absorbing rollers. Since the base of the recesses is considerably broader than the diameter of the rollers, ample space is provided around the rollers for accommodating any expansion of the rollers. The depth of the recesses 32 is sufficient to accommodate a substantial portion of the rollers 26 and yet allow a portion of the rollers to project out beyond the winding surface 18 of the central drum 14 (see FIG. 2*a*) in order to present a surface for direct contact with the pulling line 20 being wound on the central drum.

The effect of the tension absorbing rollers in dissipating the normally destructive forces generated during the high-tension winding of the pulling line 20 onto the drum 14 is illustrated in FIGS. 3 and 4. As the line winding operation begins, the pulling line 20 is initially wound over the outwardly projecting portion of the tension absorbing rollers and, depending on the separation between adjacent rollers and the tension to which the line is subjected, the line may or may not come into contact with the winding surface 18 of the central drum (FIG. 3). However, as winding progresses, the force generated by the tension on the pulling line 20 as it pulls the cable starts to build up and this causes the pulling line 20 to bear down against the rollers 26 causing them to be compressed. The resulting deformation of the rollers is easily accommodated by the unoccupied area of the recesses 32 which surrounds the rollers. As the compressive forces build up, the tension absorbing rollers are progressively deformed within their respective recesses (FIG. 4), thereby acting to dissipate the forces so as to preclude the possibility of the central drum collapsing as a result of the high tension winding operation.

According to a feature of this invention, the winding spool is adapted to retain the tension absorbent rollers without any external securing means. To accomplish this, the winding drum is provided with notches defined on either end of the winding surface which function to securely retain the rollers in the corresponding recessed areas on the drum. This is illustrated in FIG. 5, which is a cross-sectional end view of the improved cable winding drum of FIG. 1, illustrating clearly the lateral positioning of one of the tension absorbing rollers on the central drum. As shown, the tension absorbing rollers 26 are laterally disposed along the recessed areas on the winding surface of the central drum. The enlarged disc-like ends 16 on either end of the central drum have angular notches 36 defined at the junction between their ends 16 and the winding surface on the central drum 14. The notches 36 are dimensioned so as to securely accommodate the ends of the tension absorbent rollers. The length of the rollers 26 is made to be sufficiently larger than the width of the central drum 14 so that the rollers project on either end into the notches 36 of the disc-like ends. The rollers are thus rigidly held in position because of the restraining effect of their matching size with the recessed areas 32 as well as the end notches 36.

Because of the flexible nature of the rubbery material of which the tension absorbing rollers are made, they can be easily positioned on the central drum by first placing one end of a roller into one of the end notches and then bending the roller slightly in order to place it along the recessed area and into the corresponding end notch on the opposite side of the central drum. A similar approach makes the retrieval of the rollers, for their replacement, very convenient.

As also shown in FIG. 5, as the pulling line 20 is wound, the various turns of the line get spread out over the length of each of the tension absorbing rollers on the winding surface of the central drum and each of the turns causes a deformation of the section of the rollers below it which in turn is accommodated by the recessed areas below the rollers. Hence, as the winding operation proceeds and the number of turns of the pulling line increases, the forces generated by winding the pulling line against the tension of the cable and its weight are progressively distributed and dissipated across the width of the winding surface of the central drum.

The illustrative tension take-up system is also effective in cases where tensioned heavy cable is directly wound onto the suppport drum since the tension absorbing rollers are capable of dissipating the forces generated due to the tension of the cable and its weight as it is being wound It will be apparent to those skilled in the art that the material of the rollers, their size, and their distribution over the periphery of the central drum are among the parameters that control the force dissipation and absorption capacity of the improved drum according to this invention, and can be defined on the basis of the specific application where the system is to be used. From the foregoing, it is apparent that this invention provides an improved tension take-up system for cable winding drums which permits high tension winding of pulling line for heavy cable without collapsing the drums. The system is extremely simple and economical to manufacture and use and requires little, if any, maintenance and can be adapted for use in a variety of cable winding applications.

I claim:

1. A tension take-up system for positioning a cable under tension by using pulling line or the like attached to the cable, comprising a substantially cylindrical central drum having a winding surface defined around it onto which the line pulling the cable may be wound, and a plurality of tension absorbing means disposed in recessed areas defined longitudinally across said winding surface of the drum said tension absorbing means normally being partially disposed within said recessed area and capable of progressively deforming so as to be totally disposed within said recessed areas so as to absorb and dissipate forces generated as the tensioned pulling line is wound over said winding area of said central drum.

2. A tension take-up system for positioning a cable under tension by using pulling line or the like attached to the cable, comprising a substantially cylindrical central drum having a winding surface defined around it onto which the line pulling the cable may be wound, and a plurality of tension abosrbing means in the form of cylindrical rollers placed in recessed areas defined longitudinally across said winding surface, said rollers normally being partially disposed within said recessed areas and capable of being progressively deformed so as to be totally disposed within said recessed areas as said tensioned pulling line is progressively wound around said central drum, said recessed areas being shaped so as to accommodate said deformation of the rollers.

3. The tension take-up system of claim 2 wherein said tension absorbing rollers are made of a resilient rubbery material.

4. The tension take-up system of claim 3 wherein each of said recessed areas includes notches defined at either end of the winding surface of said central drum, said notches operative to firmly retain said rollers within said recessed areas.

5. The tension take-up system of claim 1 wherein said tension absorbing means are made of a resilient rubbery material.

6. The tension take-up system of claim 5 wherein each of said recessed areas includes notches defined at either end of the winding surface of said central drum, said notches operative to firmly retain said tension absorbing means within said recessed areas.

* * * * *